United States Patent [19]

Lee

[11] Patent Number: 4,869,509

[45] Date of Patent: Sep. 26, 1989

[54] GOLFER'S HEAD MOVEMENT INDICATOR

[76] Inventor: Sung Y. Lee, 99-639 Aiea Heights Dr., Aiea, Hi. 96701

[21] Appl. No.: 235,060

[22] Filed: Aug. 23, 1988

[51] Int. Cl.[4] ..... A63B 69/36

[52] U.S. Cl. ..... 273/183 B; 2/199; 340/573; 273/DIG. 17; 273/DIG. 30

[58] Field of Search ..... 2/209.1, 209.2, 196, 2/185 R, 199; 273/183 B, 190 R, 190 A; 340/573

[56] References Cited

U.S. PATENT DOCUMENTS

| | | | |
|---|---|---|---|
| 3,025,064 | 3/1962 | Flood | 273/183 B |
| 3,594,007 | 7/1971 | Kalberer | 273/183 B |
| 4,098,509 | 7/1978 | Van Krevelen | 273/183 B |
| 4,303,244 | 12/1981 | Uppvall | 273/183 B |
| 4,392,830 | 7/1983 | Salzman et al. | 273/183 B |
| 4,484,363 | 11/1984 | Varanese | 2/109.1 |
| 4,502,035 | 2/1985 | Obenauf et al. | 273/183 B |
| 4,527,982 | 7/1985 | Salzman et al. | 434/258 |
| 4,560,166 | 12/1985 | Emerson | 273/183 B |
| 4,667,274 | 5/1987 | Daniel | 2/199 |
| 4,768,232 | 9/1988 | Villalobos | 2/196 |

*Primary Examiner*—George J. Marlo

*Attorney, Agent, or Firm*—Dennison, Meserole, Pollack & Scheiner

[57] ABSTRACT

A golfer's training aid which audibly signals any improper head motion during a golf swing. A compact, integrated unit contains a battery, an on-off switch, a buzzer and a motion sensor all electrically connected in series and mounted inside the front panel of a golfer's cap. Any improper head movement during the swing is sensed by the motion sensor which activates the buzzer.

6 Claims, 2 Drawing Sheets

GOLFER'S HEAD MOVEMENT INDICATOR

BACKGROUND OF THE INVENTION

This invention relates to a training aid which is readily attached to the cap of a golfer to signal any improper head movement during a golf swing. The attainment of a superior golf game requires rigorous control over a number of key body positions; the stance, the golf grip, and head position being amongst the most important. Professional golfers recognize the importance of keeping the head down and immobile during that critical period of the gold swing just prior to the ball being struck by the club. Head movement during this period will result in reflex motions of other body muscles which have the effect of deflecting the swing to cause the club head to strike the ball slightly off the optimum striking zone. This, of course, introduces unwanted deviation from the desired directional path of the ball.

Problems in keeping the head immobile and the eyes fixed on the ball during the swing are experienced by many golfers. There is a natural tendency to turn the head in the direction of the swing to watch the ball. Also, since so many factors need to be combined to achieve a successful swing, it is an easy matter to forget the importance of keeping the head immobile.

A large number of training aids for teaching proper head positioning have been invented as typified by U.S. Pat. No. 3,025,064, issued Mar. 13, 1962 to B. W. Flood; U.S. Pat. No. 3,594,007, issued July 20, 1971 to Karl H. Kalberer; U.S. Pat. No. 4,098,509, issued July 4, 1978 to Nellis D. Van Krevelen; U.S. Pat. No. 4,527,982, issued July 9, 1985 to Norman Salzman; and U.S. Pat. No. 4,560,166, issued Dec. 24, 1985 to Edwin E. Emerson.

The patent to Flood shows a motion sensor mounted in a golfer's cap. Head motion causes a rolling ball in the sensor to hit a wall surface emitting an indicating click. Kalberer shows an inertia operated arm which is clipped to the visor of a golfer's cap. Sudden head movement trips a spring pulling the arm against the visor signalling improper head motion. Van Krevelen shows a bell pivotally mounted on the end of the visor of a golfer's cap to signal head motion. Salzman shows a wire contact mounted on a head band and arranged to cooperate with a shoulder mounted contact. A signalling circuit is completed when the head mounted contact touches the shoulder contact. Emerson shows a momentum switch mounted on the end of the visor of a golfer's cap. Movement of the head is sensed by the momentum switch to operate a signalling device. The momentum switch can be disabled by an inhibitor switch if the head moves after the ball is struck.

While the above mentioned patents do teach head control training devices, the prior art does not teach a head control training device having the flexibility of attachment, the compactness, the feature of adjustability, and the overall ease of operation found in the instant invention.

SUMMARY OF THE INVENTION

The overall object of the present invention is to improve upon the wide variety of head motion training devices heretofore available by increasing the ease of installation and simplicity of operation. Although primarily designed and described as a golfer's head control training aid, the invention is adaptable to other activities such as tennis, bowling, fishing, and as a driver's alert.

It is a specific object of the invention to provide a small, self-contained battery powered head motion sensor to be installed in a golfer's cap which can be activated and deactivated by operation of a simple switch. When activated prior to a golf swing, a buzzer will sound upon detection of improper head motion. When the switch is deactivated, the training aid is carried in the golfer's cap unnoticed and without any interference with all other activities.

It is another object of the invention to provide a head motion training aid that comprises a small integrated package which can be inconspicuously carried in a golfer's cap. The small dimensions and minor weight of the unit render it imperceptible to the wearer.

It is yet another object of the invention to provide a system for mounting the training aid in any conventional golf cap. The mounting system also provides an element of adjustment to optimize performance to the individual needs of the golfer.

DESCRIPTION OF THE PREFERRED EMBODIMENT

Figure 1:
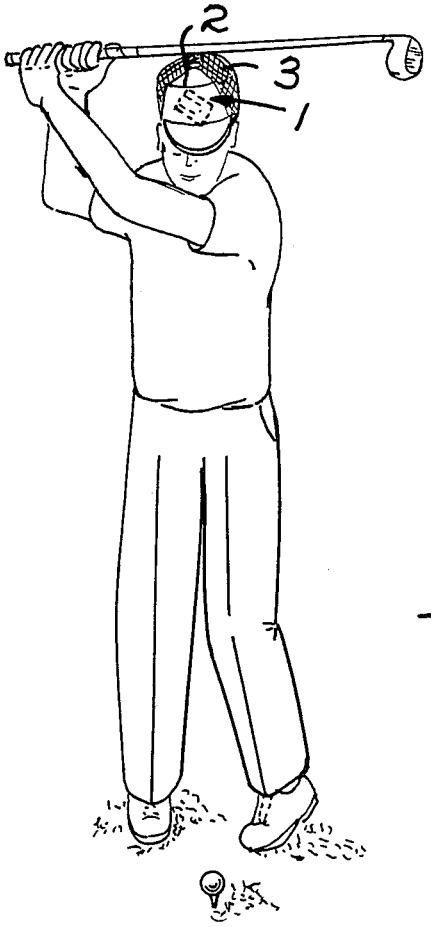
FIG. 1 shows a golfer at the beginning of a swing with the motion training device mounted in position within the golf cap.

Referring now in general to the drawings, and in particular to FIG. 1, a golfer is shown in a preferred body position at the beginning of a golf swing. The head is kept slightly down with the eyes fixed on the ball. The head must be kept substantially fixed in this position during the period that the club traces a striking arc culminating in contact with the ball. As previously explained, any head motion during this period sets up involuntary body movements which introduce errors in this critical striking arc. To indicate to the golfer if there has been any improper head motion, head motion training device 1 is installed inside the front panel 2 of golf cap crown 3.

Figure 8:
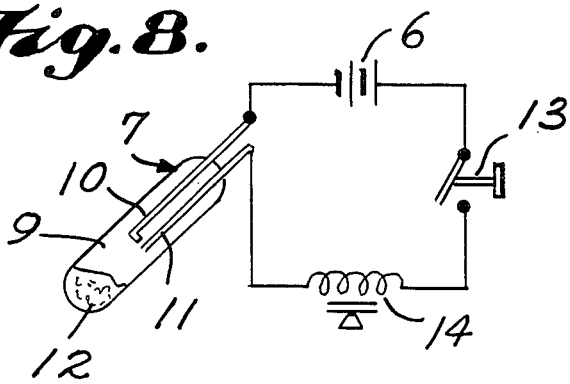
FIG. 8 is a circuit diagram illustrating the electrical operation.
Figure 2:
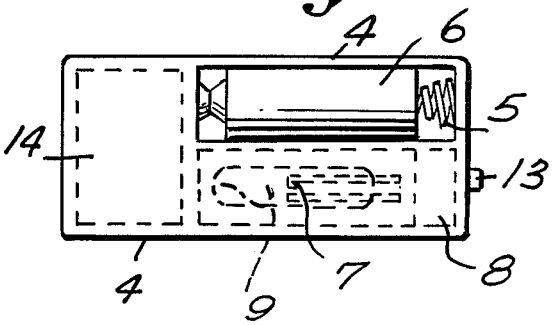
FIG. 2 is a front view of the head motion training device with the battery cover removed.
Figure 3:
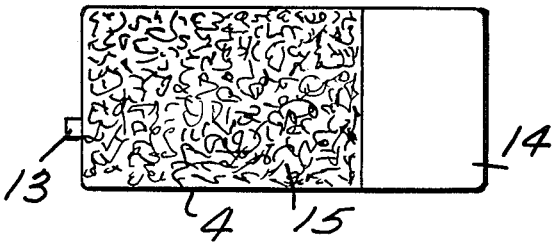
FIG. 3 is a back view of the training device showing the Velcro pad mounted thereon.

Referring now to FIGS. 2, 3 and 8, head motion training device 1 comprises a plastic housing 4 having an upper battery compartment 5 which houses a small battery 6. A battery cover, not shown, closes the upper compartment after battery 6 has been installed. A motion sensing switch 7 is mounted within a lower compartment 8 of housing 4. Although many motion sensing switch types, as shown in the prior art, can be used, a mercury sensing switch is preferred. Switch 7 comprises a sealed glass tube 9 housing a pair of contacts 10, 11 and a globule of mercury 12. Any sudden change in motion will cause mercury globule 12 to bridge contacts 10 and 11. A switch 13 is also mounted in lower compartment 8. Switch 13 is here shown as an on-off push button switch, however, a conventional slide switch may also be employed.

A small conventional buzzer 14 is adhesively or mechanically attached to an end portion of housing 4. The overall dimensions cf buzzer 14 are compatible with housing 4 to define a substantially rectangular three-dimensional package.

FIG. 3 shows the rear side of housing 4 and attached buzzer 14. A Velcro patch 15 is mounted on the rear side of housing 4 to facilitate an adjustable mounting in the golfer's cap as will be explained in connection with FIGS. 4–7.

Although there is nothing critical in the precise dimensions of housing 4 and attached buzzer 14, some exemplary dimensions will be given to illustrate the compact nature of the device. The overall unit is $2\frac{1}{4}$ inches long, 1 inch wide, and $\frac{1}{2}$ inch deep with an overall weight of about $1\frac{3}{4}$ ounces. Again, it is emphasized that the dimensions and weight can be increased or decreased depending upon the type of internal components used.

The electrical operation will be explained in connection with FIG. 8. The device employs a simple series circuit consisting of battery 6, switch 13, buzzer 14, and motion sensing switch 7. When switch 13 is closed, the circuit is under control of motion sensor 7 at contacts 10 and 11. With the motion sensor switch 7 positioned in the golf cap as shown in FIG. 1 with the golfer's head down and immobile, the mercury globule 12 will be at rest at the bottom of sealed glass tube 9. Contacts 10 and 11 will be open and the buzzer will not sound. However, if during the swing, the head moves more than a predetermined amount, the mercury globule 12 will bridge contacts 10 and 11 to complete the circuit causing the buzzer 14 to sound. This indicates to the golfer that he has made a defeative swing.

Figure 4:
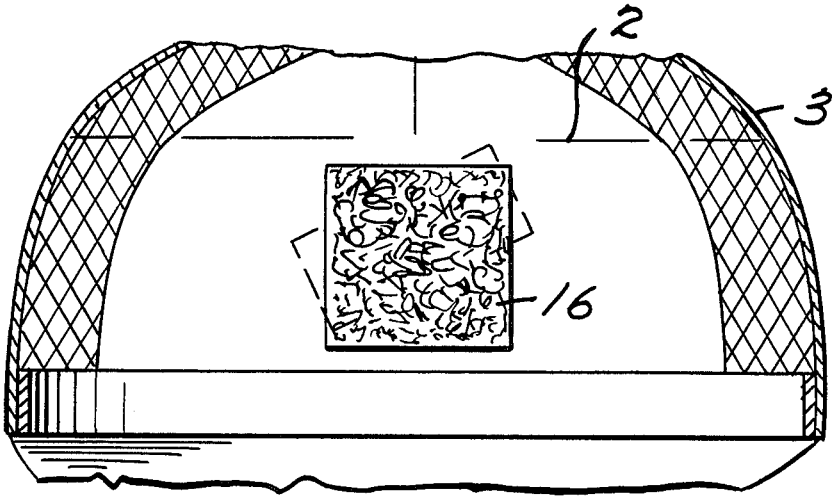
FIG. 4 is an inside view of the front crown portion of the golfer's cap showing the Velcro mounting pad secured thereon with appropriate locating indicia marked therein.

An important aspect of the invention concerns the manner of positioning the training device 1 in golf cap 3. Referring now to FIG. 4, one element of a hook and loop fastening system marketed under the trademark "Velcro" 16 is adhesively fixed to the interior of the golf cap in a substantially central position on the front panel 2 of the crown 3. Velcro patch 16 will generally be positioned behind some decorative insignia usually found on the outside of the front panel of the golf cap crown. Velcro patch 16 is positioned at this location to receive the other element of the hook and loop fastener 15 mounted on the training device 1 in order to hold the training device in a fixed position within the golf cap crown 3.

Figure 5:
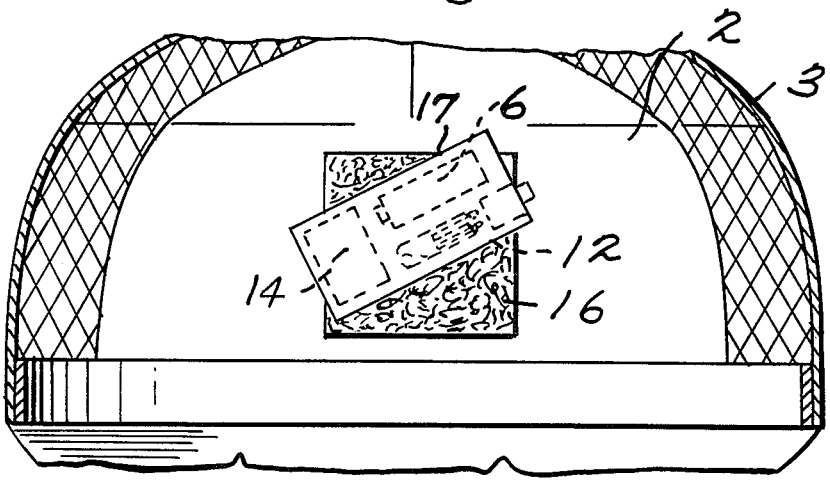
FIG. 5 shows the training device mounted on the Velcro mounting pad shown in FIG. 4.

Referring now to FIG. 5 which is an inside view similar to FIG. 4 of the golf cap crown, the training device 1 is shown attached to Velcro patch 16 by means of Velcro patch 15, not visible in this view. The training device is positioned at an angle to a vertical center line running through the cap so that the mercury globule 12 rests on the bottom of its glass container in an open circuit position at the starting point of the swing. The exact angle of attachment is determined through trial and error. The golfer runs through a number of practice swings, adjusting the angle of attachment between patches 15 and 16, until the buzzer signals at a predetermined level of improper head movement.

Once this adjustment is arrived at, it can be marked by framing the training device in the cap with a felt-tipped pen as shown at 17. In this manner, the training device may be temporarily removed to replace a battery, or for any other purpose, and then replaced in its optimum position without having to repeat the experimental positioning procedure outlined above.

Figure 6:
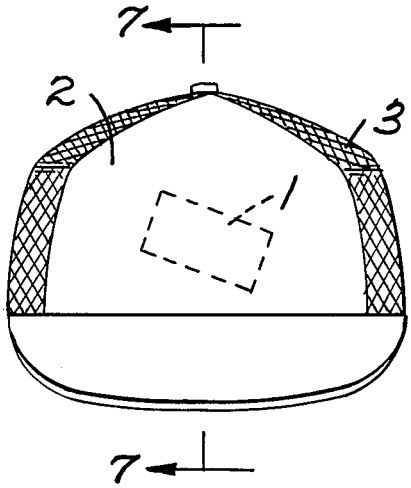
FIG. 6 is an outside view of the golf cap showing the position of the training device.

FIG. 6 is a front view of the golf cap showing the outside outline of the training device 1 in phantom.

Figure 7:
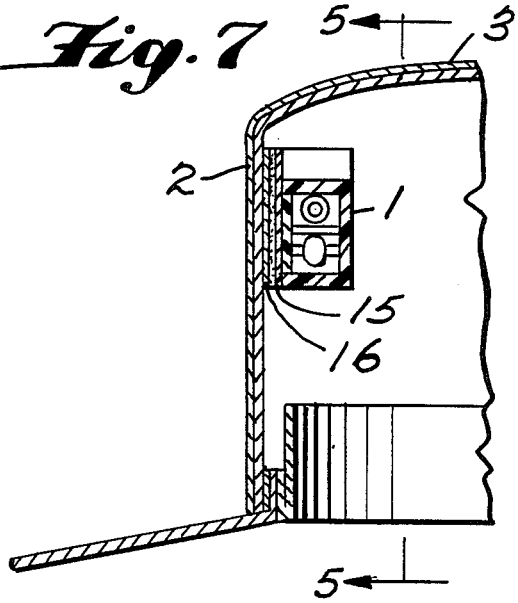
FIG. 7 is a sectional view along lines 7—7 of FIG. 6 showing the training device mounted on the Velcro pads.

FIG. 7 is a sectional view of FIG. 6 showing the training device positioned on the front panel 2 of the golf cap crown 3.

In use, after the training aid is installed and calibrated in the golf cap, switch 13 is turned on. The switch may be operated by removing the cap, turning the switch on and quickly repositioning the cap on the head with minimum buzzer operation. Alternatively, the switch may be operated by "feel" with the cap properly positioned on the head. The switch operator can be easily felt through the material of the cap and operated by a pinching motion of the fingers.

With the switch now set in its operating position, the buzzer will sound if there is any improper head motion during the golf swing. To disable the unit, switch 13 is opened and the training device may be left in place in the cap without in any way interfering with the activities of the wearer.

It is not intended to limit the present invention to the details of illustration or terms of description of the single preferred embodiment shown above. It will be appreciated by those skilled in the art that various modifications and alterations therein may be made within the scope of the present invention.

I claim:

1. A golf swing monitor to audibly signal improper head movement during a golf swing comprising a compact, integrated housing including a battery, an on-off switch, a signal buzzer and a motion sensing switch all connected in a series circuit, a golf cap including a visor, a crown, and a front crown panel extending above the visor, first support means medially located on the inside surface of said front crown panel, second support means on an exterior surface of said housing, said second support means being attached to said first support means in a predetermined angular position whereby when said golf cap is worn by a golfer during a golf swing and said on-off switch is in an on position, the buzzer will sound on the occurrence of any improper head movement as sensed by said motion sensing switch.

2. The apparatus as claimed in claim 1 wherein said motion sensing switch comprises a sealed glass tube, a pair of fixed contacts in said tube, and a globule of mercury in said tube for bridging said contacts upon predetermined motion of said tube.

3. The apparatus as claimed in claim 2 wherein said first and second support means comprise patches of a hook and loop fastening material and wherein said second patch is attached to said first patch to provide said predetermined angular position.

4. The apparatus as claimed in claim 3 wherein said predetermined angular position is such that said mercury globule in said,sealed glass tube is in an open circuit position at the beginning of a golf swing, but in a closed circuit position upon occurrence of improper head movement.

5. The apparatus as claimed in claim 4 wherein said predetermined angular position is indicated on the internal front crown panel by framing said integrated housing thereon with a marking device.

6. The apparatus as claimed in claim 2 wherein said housing comprises an upper battery compartment and a lower compartment for said motion sensing switch and said on-off switch, said buzzer being secured to an end wall of said housing.

* * * * *